US006491189B2

(12) United States Patent
Friedman

(10) Patent No.: US 6,491,189 B2
(45) Date of Patent: Dec. 10, 2002

(54) DISPENSING VALVE FOR FLUIDS

(75) Inventor: Mitchell A. Friedman, Randallstown, MD (US)

(73) Assignee: International Dispensing Corporation, Millersville, MD (US)

( * ) Notice: Subject to any disclaimer, the term of this patent is extended or adjusted under 35 U.S.C. 154(b) by 0 days.

(21) Appl. No.: 09/827,549

(22) Filed: Apr. 6, 2001

(65) Prior Publication Data

US 2001/0052530 A1 Dec. 20, 2001

Related U.S. Application Data

(60) Provisional application No. 60/195,232, filed on Apr. 7, 2000, and provisional application No. 60/204,326, filed on May 15, 2000.

(51) Int. Cl.[7] ..... B67D 3/00

(52) U.S. Cl. ..... 222/518; 222/509; 251/339; 267/161

(58) Field of Search ..... 222/107, 402.1, 222/402.13, 402.25, 511, 518, 501, 509; 251/339; 137/625.33; 267/161, 277, 219

(56) References Cited

U.S. PATENT DOCUMENTS

| | | | | | |
|---|---|---|---|---|---|
| 1,033,325 | A | * | 7/1912 | Keiser | 137/625.33 |
| 2,696,934 | A | * | 12/1954 | Ashton | 222/518 |
| 2,764,324 | A | | 9/1956 | Landreth | |
| 3,187,965 | A | * | 6/1965 | Bourget | 222/518 |
| 3,263,875 | A | | 8/1966 | Lofdahl | |
| 3,315,850 | A | | 4/1967 | Gran | |
| 3,620,425 | A | | 11/1971 | Ralt | |
| 3,981,419 | A | | 9/1976 | Nilson | |
| 4,027,865 | A | * | 6/1977 | Greenwood et al. | 267/148 |
| 4,440,316 | A | | 4/1984 | Christine | |
| 4,452,425 | A | | 6/1984 | Lucking | |
| 4,564,132 | A | | 1/1986 | Lloyd-Davis | |
| 4,687,123 | A | | 8/1987 | Hyde | |
| 4,995,534 | A | * | 2/1991 | Norman | 222/511 |
| 5,447,257 | A | | 9/1995 | Dark | |
| 5,680,970 | A | | 10/1997 | Smith et al. | |
| 5,794,823 | A | * | 8/1998 | Roundtree | 222/518 |
| 5,857,595 | A | | 1/1999 | Nilson | |
| 5,918,779 | A | * | 7/1999 | Ventura | 222/402.1 |
| 6,045,119 | A | | 4/2000 | Erb | |
| 6,095,379 | A | * | 8/2000 | Martinez et al. | 222/402.13 |

* cited by examiner

*Primary Examiner*—Henry C. Yuen
*Assistant Examiner*—Stephanie L. Willatt
(74) *Attorney, Agent, or Firm*—Whiteford Taylor & Preston, LLP; Gregory M. Stone; Jeffrey C. Maynard

(57) ABSTRACT

A dispensing valve is disclosed which requires only a minimal force exerted on the valve actuator to maintain the valve in an open position. A resilient valve actuator having the characteristics of a nonlinear spring is provided at an actuator end of the valve body and operatively connected to a plunger, with the opposite end of the plunger mounting a resilient valve seal which serves to open and close a plurality of port openings. The valve is configured so as to allow it to be sterilized through high levels of radiation and through high temperature steam and chemical sterilization processes without degrading the valve structure or operation.

49 Claims, 9 Drawing Sheets

DISPENSING VALVE FOR FLUIDS

CROSS-REFERENCE TO RELATED APPLICATIONS

The present application is based upon and gains priority from U.S. Provisional Patent Application Ser. No. 60/195,232, filed Apr. 7, 2000 by the inventor herein and entitled "Dispensing Valve for Fluids," and U.S. Provisional Patent Application Ser. No. 60/204,326, filed May 15, 2000 by the inventor herein and entitled "Dispensing Valve for Fluids,"0 the specifications of which are incorporated herein by reference.

BACKGROUND OF THE INVENTION

1. Field of the Invention

The present invention relates to fluid dispensing apparatus and, more particularly, to a robust, relatively simple, low-cost, and easily actuatable dispensing valve for dispensing fluid from a source of such fluid, which valve may withstand sterilization procedures including irradiation up to 5.0 MRAD and high temperature steam and chemical sterilization processes without degradation of the integrity of the valve structure or operation, and thus may be used for dispensing a wide variety of products ranging from aseptic products (free from microorganisms), to sterile products, to non-sterile products.

2. Description of the Background

Dispensing valves for dispensing fluid from fluid containers, systems, or other sources of such fluid are shown by U.S. Pat. Nos. 3,187,965; 3,263,875; 3,493,146; 3,620,425; 4,440,316; 4,687,123; and 5,918,779. Such valves can be used, for example, in a system for dispensing beverages or other liquids used by consumers in the home. Low cost, trouble-free, and reliable valve action are significant considerations in these applications. Low cost is particularly important if the valve is to be sold as a disposable item as, for example, where the valve is provided with a filled fluid container and discarded along with the container when the fluid has been consumed.

In U.S. Pat. No. 3,187,965, a dispensing valve for a milk container is shown having a generally integral valve body connected at one end to the milk container. The valve body has an L-shaped passage formed therein defining an inlet opening at one end in communication with the milk container and at the opposite end a discharge outlet for discharging the milk to the exterior of the container. A plunger bore in the valve body provides means for slidably mounting a plunger member. A valve seal fixedly connected to the inner end of the plunger member can be moved by the plunger member to open and close the inlet opening. The opposite or outer end of the plunger member extends to the exterior of the milk container. A push button having a diameter substantially larger than the plunger member is mounted to the outer end of the plunger member and disposed in the valve body so that the push button is exposed for engagement by a user's finger. A compression type spring is engaged between the push button and the valve body. Thus, when a force is exerted against the push button to move the valve seal and open the inlet opening for dispensing milk from the container, the spring at all time exerts a substantial counter force on the push button for returning the valve seal to a closed position. The force exerted by the compression spring tends to increase directly with the inward displacement of the plunger member. Therefore, the user must exert considerable inward force on the push button to hold the valve open.

Another valve, shown in U.S. Pat. No. 3,263,875, uses a similar plunger member and valve body to that of the '965 patent. A resilient diaphragm having a peripheral portion engaged with the valve body acts both as a return spring and as a push button. Unfortunately, commercially-available valves having such diaphragmatic actuator members have in the past required the user to exert considerable force to hold the valve open while dispensing the liquid.

Likewise, commercial attempts have been made to provide low-cost dispensing valves for use with disposable containers, but such efforts have met with limited success. For example, Waddington & Duval Ltd. provide a press tap for use with disposable containers (such as wine boxes, water bottles, and liquid laundry detergent containers) under model designations COM 4452 and COM 4458, both of which provide a depressible button actuator operatively connected to a valve closure for moving the valve closure away from a valve seat to dispense fluid. Unfortunately, the valve constructions are configured such that fluid to be dispensed will rest within the dispensing chamber of the valve behind the valve seat after use and thereby outside of any refrigerated or insulated container in which the liquid is stored, thus increasing the risk of spoilage of the volume of fluid resting within the valve body after each use. Moreover, many fluid dispensing applications require vigorous sterilization procedures prior to use of the dispensing equipment, including irradiation at exposures of up to as high as 5.0 MRAD, and high temperature steam and chemical sterilization procedures. The thin-walled polyethylene construction of the valve bodies of the Waddington & Duval dispensing valves cannot withstand such sterilization procedures, and in fact become brittle and prone to failure when exposed to such procedures, thus greatly limiting their use for dispensing food products. Even further, the polyethylene valve closure of the Waddington & Duval dispensing valve construction is highly thermally conductive, such that heat transfer may easily occur between the exterior of the fluid container and the contents of the container simply through the valve structure, again raising the risk of spoilage of the contents.

Similarly, the Jefferson Smurfit Group provides a similar tap for use with disposable containers under the model designation VITOP. Once again, the Jefferson Smurfit Group tap construction is configured such that fluid to be dispensed will rest within the dispensing chamber of the valve behind the valve seat after use and thereby outside of any refrigerated or insulated container in which the liquid is stored, once again increasing the risk of spoilage of the volume of fluid resting within the valve body after each use. Likewise, the thin-walled polypropylene construction of the valve body of the Jefferson Smurfit Group dispensing valve cannot withstand the above-described sterilization procedures, and also becomes brittle and prone to failure when exposed to such procedures, thus greatly limiting their use for dispensing food products. And, as above, the polyester elastomer closure of the Jefferson Smurfit Group dispensing valve construction is highly thermally conductive, such that heat transfer may easily occur between the exterior of the fluid container and the contents of the container simply through the valve structure, again raising the risk of spoilage of the contents.

Thus, although substantial effort has been devoted in the art heretofore towards development of low-cost valves of this general type, there remains an unmet need for a valve which is easier to use and which does not require that the user exert such large forces to hold the valve open. This problem is complicated by the fact that the spring or other resilient member should provide the force necessary to assure leak-free seating of the valve seal when the plunger member is in the closed position. Likewise, there remains an unmet need for a disposable valve which is sufficiently robust so as to be able to withstand vigorous sterilization procedures, which reduces heat transfer through the valve between the interior and exterior of the fluid container, and which does not trap fluid outside of the intended storage vessel between dispensing cycles.

Moreover, for a dispensing valve provided as a component of a throw-away fluid container, it would be highly advantageous to provide an easy to use dispensing valve which offers the user assurance that the valve has not previously been used or tampered with, and that the integrity of the contents of the fluid container has not been compromised. Unfortunately, the need for such a feature has not been met by prior art dispensing valves.

There is further need for a valve which can be adapted, during manufacture, to provide the desired liquid flow rate for a particular set of conditions such as liquid viscosity and the liquid pressure or "head" available to force the liquid through the valve body. A valve which discharges a thick, high-viscosity fluid such as cold maple syrup or orange juice concentrate at a desirable rate will discharge a low-viscosity fluid such as water or wine under the same pressure at a far higher rate. It would be desirable to provide a valve which can be fabricated readily using normal production techniques such as injection molding in a range of configurations, having different resistance to fluid flow, to provide for these different conditions. It would be particularly desirable to provide a valve which can be fabricated in these different configurations while with only minor modifications to the molds and other tools used to make the valve.

SUMMARY OF THE INVENTION

It is, therefore, an object of the present invention to provide a fluid dispensing valve which avoids the disadvantages of the prior art.

It is another object of the present invention to provide a fluid dispensing valve which requires minimal force to maintain the valve in an open position while providing leak-free closure of the valve when seated in a closed position.

It is yet another object of the present invention to provide a fluid dispensing valve which may be manufactured in a variety of configurations to allow effective application to fluids of varying viscosities with only minor modifications to manufacturing equipment used to make the valve.

It is even yet another object of the instant invention to provide a fluid dispensing valve which provides a user a means of determining whether or not the valve has previously been actuated and possibly compromised the integrity of the fluid to be dispensed.

It is still even yet another object of the instant invention to provide a fluid dispensing valve which is of sufficiently robust construction so as to withstand sterilization procedures including exposure to high levels of radiation and high temperature steam and chemical sterilization without degrading the performance or integrity of the valve structure.

It is still yet another object of the instant invention to provide a fluid dispensing valve which reduces heat transfer from the exterior of a liquid container to which the valve is attached to the interior of the container.

It is still even yet another object of the instant invention to provide a fluid dispensing valve which prevents the storage of fluid behind the valve closure and outside of the fluid container after each dispensing cycle.

In accordance with the above objects, a dispensing valve for fluids is disclosed which provides for ease of use by requiring only a minimal force exerted on the valve actuator to maintain the valve in an open position, and which offers a simple, ergonomic design and robust functionality capable of dispensing a wide variety of products. In a first embodiment, the valve body and actuator are formed of a polypropylene copolymer with an average wall thickness of approximately 0.0625 inches, and the valve seal is formed of a thermoplastic rubber having an average thickness of about 0.032 inches. Such dimensional characteristics and materials allow the dispensing valve to withstand the highest aseptic sterilization regimentation as outlined by the Food & Drug Administration (FDA) and maintain the sterility of a product as specified by the National Sanitation Foundation (NSF) guidelines. More specifically, the dispensing apparatus is able to withstand either gamma or cobalt irradiation at the maximum dose of 5.0 MRAD (50 Kilogray) in the first phase of the sterilization process. The dispensing apparatus is then able to withstand the high temperatures associated with the steam and chemical sterilization processes required in the filling process. The dispensing apparatus is capable of withstanding these combined sterilization regimens without degrading the valve structure or operation. Thus, the valve of the instant invention may be used to dispense products ranging from aseptic products (free from microorganisms) including but not limited to dairy, 100% juice and soy products, to commercially sterile products including but not limited to preserved juice and coffee products, to non-sterile fluids such as chemical solvents.

In order to allow a minimal force for holding the valve in an open position, a resilient valve actuator having the characteristics of a nonlinear spring is provided at an actuator end of the valve body and operatively connected to a plunger, with the opposite end of the plunger having mounted thereon a resilient valve seal. An intermediate discharge outlet is positioned between the actuator end and the valve seal, such discharge outlet being placed in fluid communication with the interior of a fluid container to which the valve is attached when the valve is in an open position. A valve port wall is positioned between the valve seal and the dispensing chamber providing a plurality of ports for controlling the flow of fluid through the valve body when the valve is in an open position. The valve and the valve port wall are positioned such that when the valve is installed on a liquid container, virtually no liquid will be trapped by the valve structure outside of the insulated container, thus preventing the spoilage of a dose of liquid resting in the valve after each dispensing cycle. A push-button is provided for actuating the dispensing valve and is exposed to the exterior of a fluid container to which the dispensing valve is attached. In one embodiment of the instant invention, the push-button is concentrically mounted within a breakaway circular rim. Upon first using the dispensing valve, a user depresses the push-button, dislodging the circular rim from the button, and thereby providing evidence that the valve had been opened, thus providing a tamper-evident actuator. The valve may be manufactured with a variety of port configurations to provide for the dispensing of fluids of varying viscosities.

The simplicity and functionality of the dispensing valve of the instant invention enables its manufacture and automatic assembly with high cavity tools which in turn reduces manufacturing costs and offers the market a low cost dispensing solution. The simplicity and functionality of the design also enables the dispensing apparatus to be easily customized in the manufacturing process to fit a wide range of dispensing packages such as a flexible pouch, flexible bag, or semi-rigid plastic container. The dispensing valve of the instant invention is also configured to easily adapt to a wide range of filling machines and filling conditions worldwide.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
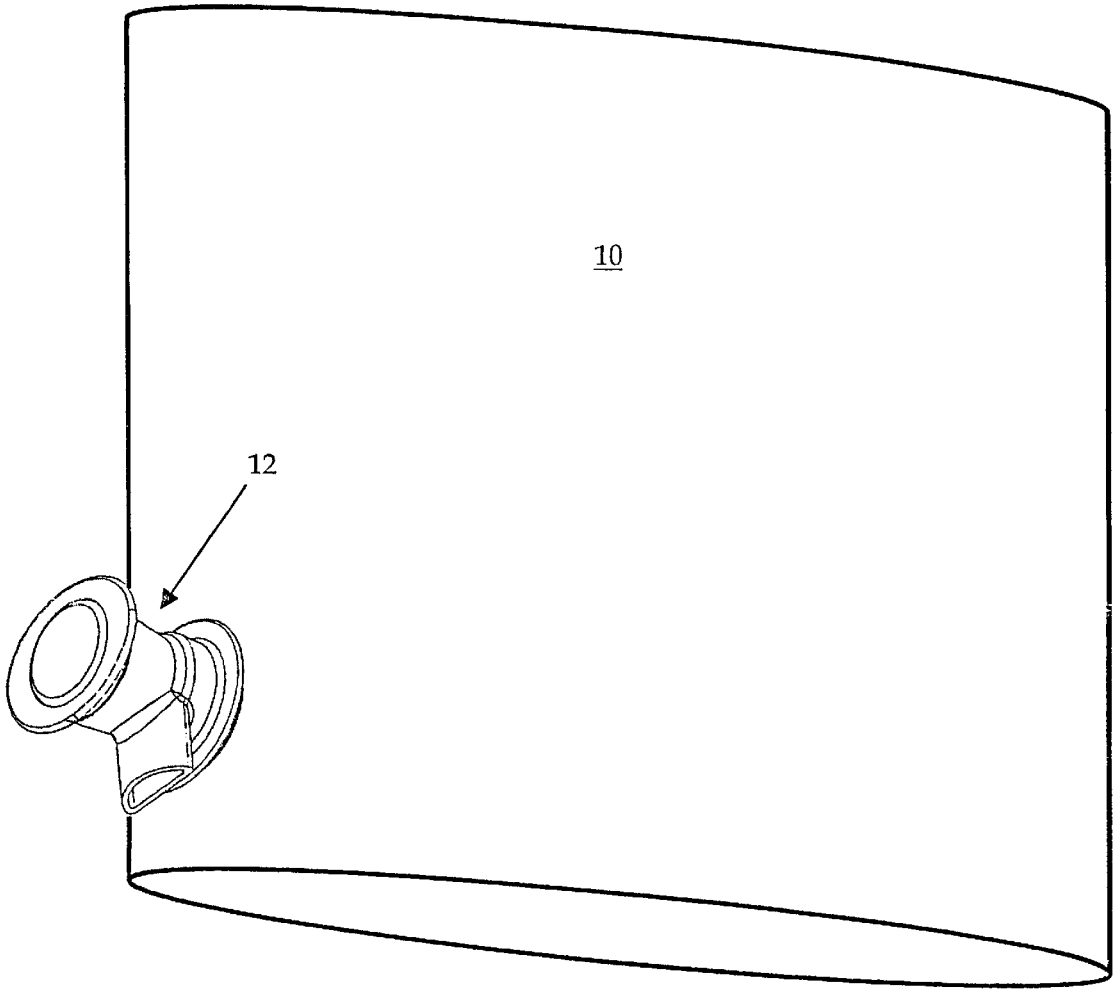
FIG. 1 shows a fluid container having a dispensing valve thereon in accordance with one embodiment of the present invention for the manual dispensing of fluid from the container.
Figure 2:
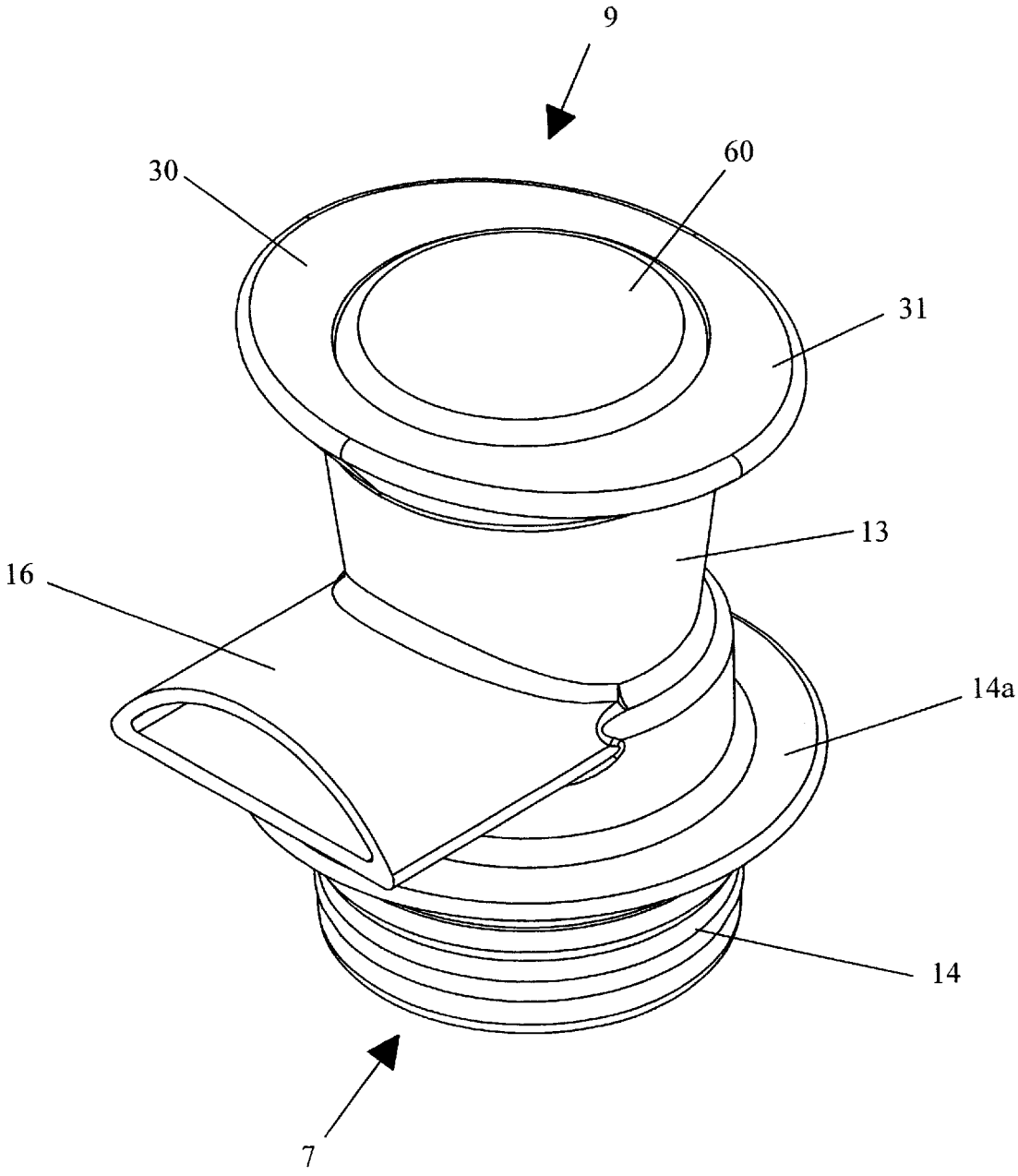
FIG. 2 is an enlarged perspective view of the dispensing valve shown in FIG. 1.
Figure 3:
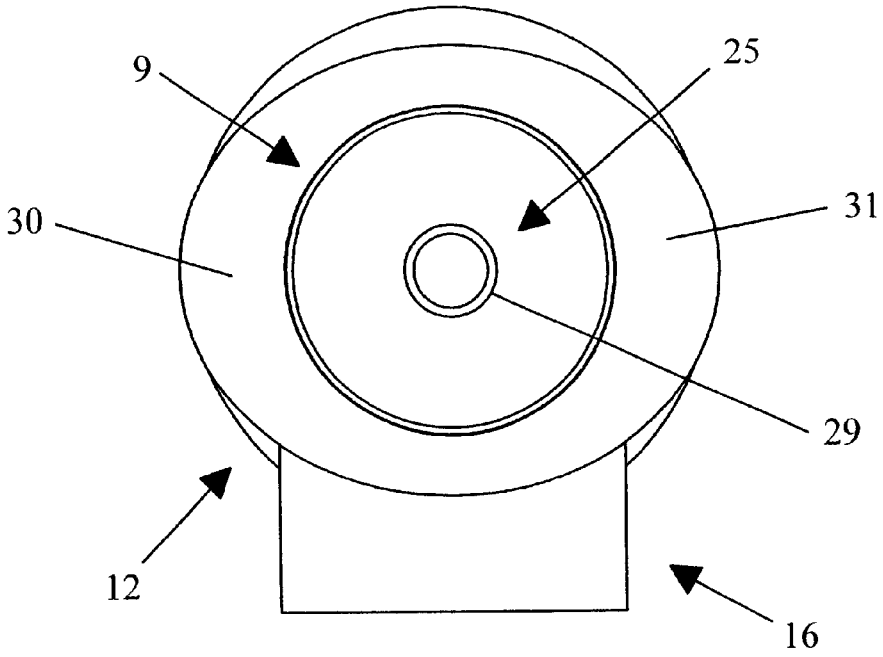
FIG. 3 is an end view of the actuation end of the dispensing valve body shown in FIGS. 1 and 2.

Referring to the drawings FIG. 1 shows a container or vat 10 having a juice or other fluid disposed therein. A dispensing valve 12 in accordance with one embodiment of the present invention is connected for dispensing the fluid in container 10. While the dispensing valve 12 is shown for dispensing the fluid under gravity flow, those skilled in the art will readily recognize that this is merely for purposes of illustration and not by way of limitation. Dispensing valve 12 is also applicable for dispensing fluid where the source of fluid is under a head of pressure provided by a source other than gravity.

As is further shown in FIGS. 2 to 7 of the drawings, dispensing valve 12 has a generally tubular valve body 13 having an outer wall 13*a* and an inner wall 13*b*. The valve body has an inner or inlet end 7, and an opposite outer or actuation end 9, and an axial direction extending between these ends. Although the valve body is shown generally in the form of a round cylindrical tube, the valve body may be round, square, octagonal or other shape adapted for the application to which the dispensing valve 12 will be applied. Valve body 13 is provided with features 14 for connecting the valve body to the container 10 or other source of fluid to be dispensed so as to bring the inlet opening 15 (FIG. 5) formed in the valve body 13 in communication with the fluid to be dispensed. The particular connecting features 14 depicted in the drawings include ribs encircling the exterior of the valve body near the inlet end 7. These ribs are arranged to form a fluid-tight, press-fit connection between the exterior of the valve body and the interior of an outlet provided in the container. Other suitable connecting and sealing features may be used in addition to or in lieu of the ribs. For example, the valve body can be provided with threads or bayonet-type locking features matable with features of the container. Also, auxiliary sealing elements such as resilient O-rings or other gaskets can be provided on the container or on the valve body for engagement between the valve body and the container.

A discharge outlet 16 is formed in the valve body at a location on the valve body between the inlet end 7 and actuator end 9. Outlet 16 is disposed outside of the container or other source of fluid when the valve body is engaged with the container. The discharge outlet 16 is generally in the form of a short tubular member extending in the direction perpendicular to the axial direction of the valve body and communicating with the interior of the valve body.

Further, a positioning ring 14*a* is provided circumscribing the valve body just above connecting features 14. When the dispensing valve of the instant invention is installed on a fluid container, positioning ring 14*a* abuts the exterior wall of the container. As will be discussed in greater detail below, a discharge outlet 16 extends from a port wall on the interior of the valve body, which port wall is ordinarily closed with a valve seal. In its closed position (seated against the port wall), the valve seal is positioned a short axial distance from positioning ring 14*a*, preferably not more than about 0.25 inches, so as to limit the amount of fluid contained within the portion of the valve outside of the fluid container to the volume within the inlet end of the valve between positioning ring 14*a* and the valve seal. By limiting the amount of fluid that may be contained within the valve structure after a dispensing cycle, the risk of subjecting a dose of liquid held within the valve after a dispensing cycle to temperature fluctuations is reduced, in turn reducing the risk of dispensing a dose of spoiled liquid at the start of the following dispensing cycle.

Figure 4:
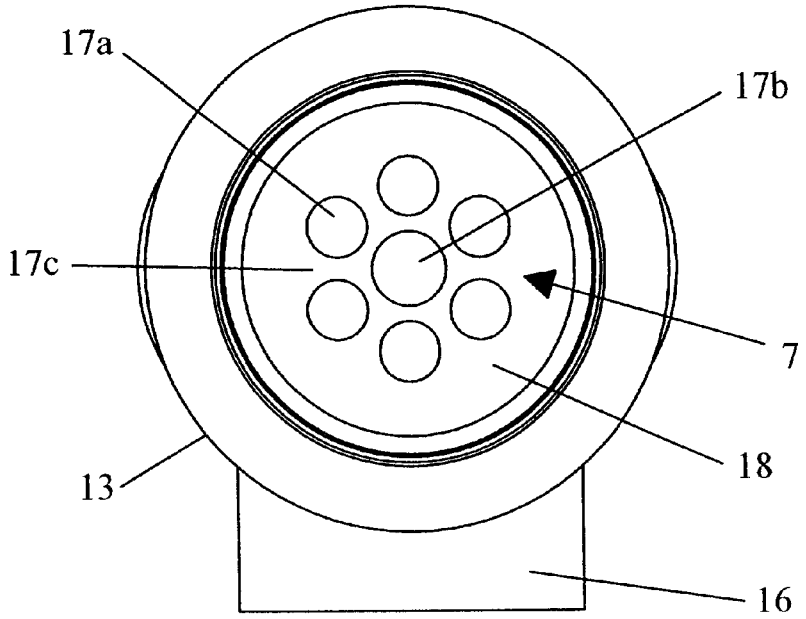
FIG. 4 is an view of the inlet end of the dispensing valve body shown in FIGS. 1 and 2.
Figure 5:
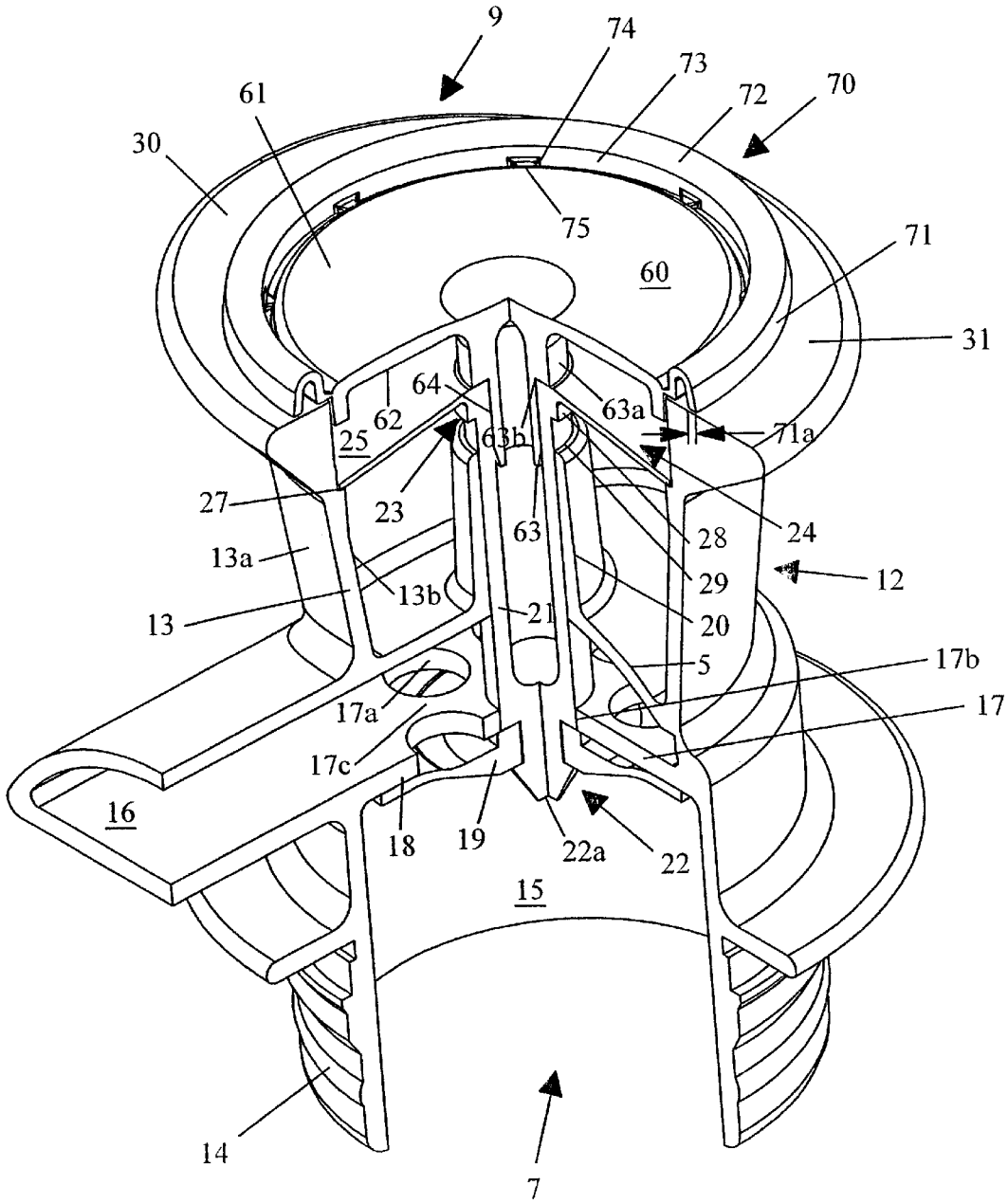
FIG. 5 is an enlarged cross-section of the dispensing valve shown in FIG. 2 with an added tamper evident feature.
Figure 5A:
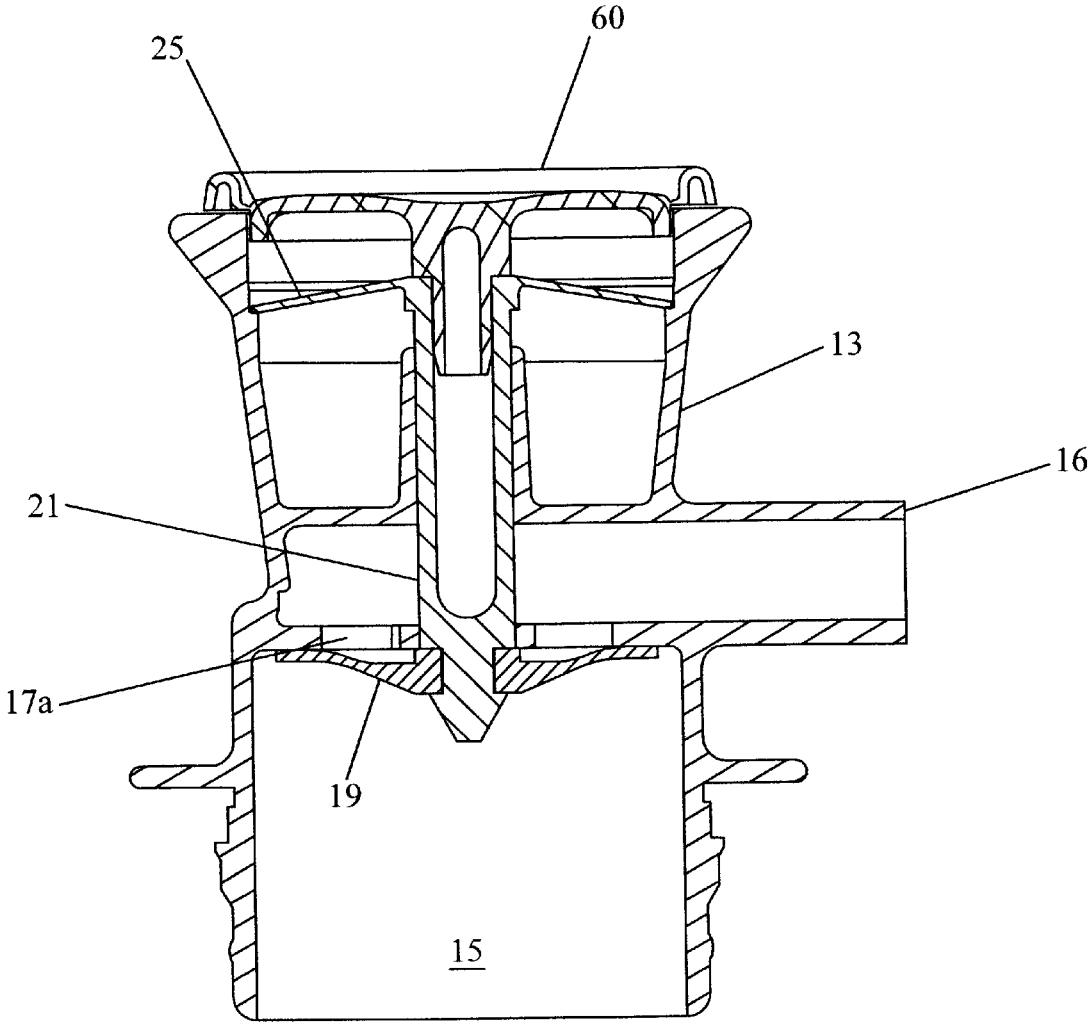
FIG. 5*a* is an enlarges cross-section of the dispensing valve shown in FIG. 2 without an added tamper evident feature.
Figure 6:
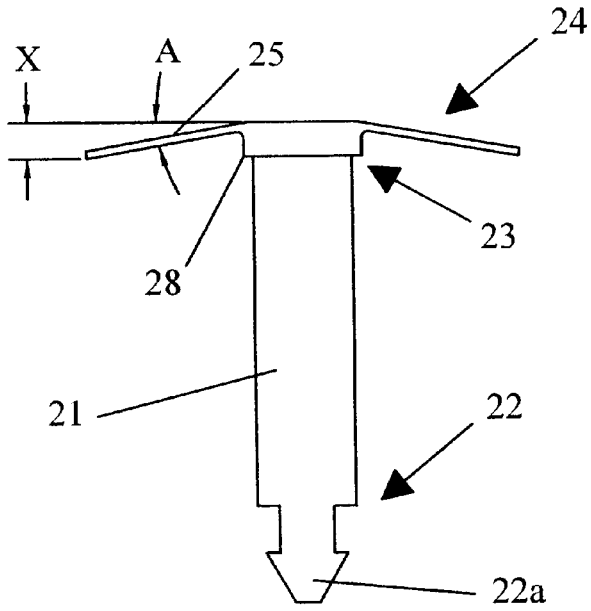
FIG. 6 is an exploded view of certain components for the dispensing valve shown in FIGS. 1–5.
Figure 7:
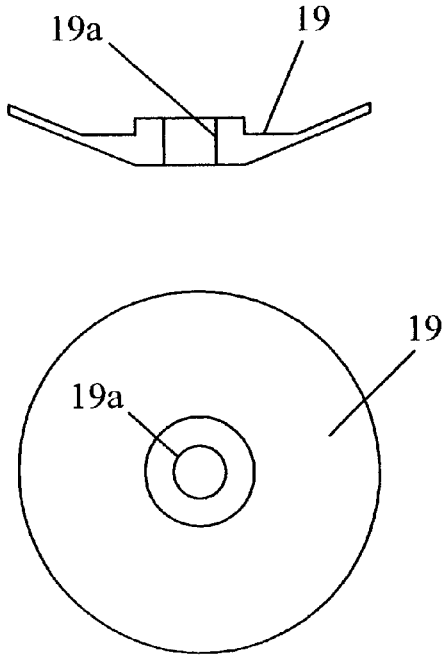
FIG. 7 is an elevational view of the valve seal shown in FIGS. 5 and 6.

As shown more particularly in FIGS. 4 and 5, valve port wall 17 extends across the interior of body 13 between inlet opening 15 and discharge outlet 16. The valve port wall defines a set of holes or valve ports 17*a*, as well as a valve seat 18 encircling the valve ports 17*a* and facing toward the inlet opening 15. The valve port wall also defines a plunger guide opening 17*b* adjacent the central axis of the valve body. As best seen in FIG. 5, a plunger guide support wall 5 extends across the valve body just outward of discharge opening 16, so that the plunger guide support wall 5 lies between the discharge opening and the actuator end of the valve body. A tubular plunger guide 20 extends outwardly from the plunger guide support wall, toward the actuator end 9 of the valve body. The plunger guide 20 is aligned with the plunger guide opening 17*b* of the valve port wall. The valve body also has a pair of grip wings 30 and 31 projecting outwardly from the remainder of the valve body at actuator end 9. Grip wings 30 and 31 extend generally in directions perpendicular to the axial direction of the valve body and perpendicular to the direction of discharge opening 16. Valve body 13 desirably is formed from a polymeric material compatible with the fluid to be dispensed as, for example, a thermoplastic such as polypropylene or other polyolefin. In a preferred embodiment, valve body 13 is formed from a polypropylene copolymer.

A plunger member 21 is slidably mounted in plunger guide 20. Plunger member 21 desirably is also made of polypropylene or other plastic material. In a preferred embodiment, plunger member 21 is likewise formed from a polypropylene copolymer. Plunger member 21 has an inner end 22 which extends through the plunger guide support wall 5, through discharge outlet 16 and through the plunger guide opening 17*b* of valve port wall 17 into the inlet opening 15.

A resilient valve seal 19 in the form of a shallow conical member is fixedly connected to the inner end 22 of the plunger member, as by a coupling element 22*a* which can be force fitted into engagement with a sized opening 19*a* in the valve seal 19 because of the resilient nature of the materials from which the valve seal 19 and plunger 21 are fabricated. Valve seal 19 can be formed from essentially any resilient material which will not react with or contaminate the fluid being dispensed, and which will not melt or degrade under the conditions encountered in service. For example, a thermoplastic or thermosetting elastomer or other flexible material, typically in the range of about 30 to about 80 Shore A durometer, and more preferably about 50 to about 80 Shore A durometer, can be employed in typical beverage dispensing applications. In a preferred embodiment, valve seal 19 is formed from a thermoplastic rubber. The periphery of valve seal 19 overlies valve seat 18 and seals against the valve seat when the valve is in the closed position depicted in FIG. 5.

The thickness of the valve seal will depend on the material and operating conditions. Merely by way of example, in a valve for dispensing beverages under gravity head (e.g., on the order of 0.5 to 1 pound per square inch pressure), the valve seal is about 1 inch in diameter and about 0.020 to 0.040 inches thick, most preferably about 0.032 inches thick, at its periphery.

A cylindrical stop member 28 and actuator 24 are formed integrally with the plunger member 21 at the outer end 23 of plunger member 21 remote from the inner end 22. Actuator 24 has a dome-shaped resilient section 25, so sized that the perimeter 26 of this dome-shaped section can be mounted or held from escaping by a ledge or groove 27 disposed on the inner wall 13*b* of the valve 13, just inward of the actuator end of the valve body 13. The dimensions of the actuator are selected to provide the desired resilient action and force/deflection characteristics as discussed below. In one exemplary embodiment, the plunger, stop member and actuator including resilient element 25 are molded as a unit from polypropylene. The resilient element 25 is generally conical and about 1 inch in diameter, with an included angle of about 160°. That is, the wall of the conical resilient section lies at an angle A (FIG. 6) of 10° to the plane perpendicular to the axial direction of the plunger member. The resilient element 25 is about 0.012 inches thick at its perimeter, and about 0.018 inches thick at its juncture with stop member 28. Stop member 28 is about 0.292 inches in diameter. Thus, the ratio between the axial extent x of the conical resilient section and the average thickness of the resilient section is about 4.

Stop member 28 coacts with a stop shoulder 29 formed by the outer end of the plunger guide 20. Thus, the distance that the plunger 21 can be moved when force is exerted on the plunger member at actuator 24 will be determined by the distance the stop member 28 can travel before contact is made with the stop shoulder 29.

In operation, the valve is mounted to the container as shown in FIG. 1. The discharge opening points downwardly outside of the container, whereas finger grip wings 30 and 31 project horizontally. The valve normally remains in the fully closed position depicted in FIG. 5. In this position, the resilience of actuator 24 urges the plunger 18 outwardly, toward the actuator end 9 of the housing, and holds the valve seal 19 in engagement with seat 18, so that the head blocks flow from the inlet opening 15 to ports 17*a* and discharge opening 16. In this condition, the pressure of the liquid 11 in the container tends to force the head against seat 18, thereby closing the valve tighter. Those portions 17*c* of the valve port wall 17 immediately surrounding the ports 17*a* support the valve seal and prevent it from buckling through into discharge opening 16. This helps to assure that the seal will not be broken in the event very large fluid pressures are applied, as may occur, for example, if container 10 is shaken or dropped. Stated another way, head 19 can be so soft and flexible that if support portions 17*c* of the valve port wall were absent, the head would be susceptible to such buckling. This ability to use a soft flexible head without fear of leakage under extreme conditions in turn facilitates formation of an effective seal at seat 18. The valve port wall also provides an additional guide for plunger 21, which facilitates sliding movement of the plunger, reduces any tendency of the plunger to bind, and keeps head 19 concentric with seat 18.

The user can open the valve by grasping the finger grip wings 30 and 31 with his or her fingers and pressing his or her thumb against the center section of the button 61 so as to intentionally move actuator 24, plunger member 21, and valve seal 19 in an opening direction aligned with the central axis of the valve body and transverse to valve port wall 17. Such movement takes the plunger member and valve seal from the normally closed position towards an open position, in which stop member 28 on the plunger engages stop wall 29 on the plunger bore of the valve body. In this open position, the valve seal is remote from valve port wall 17 and remote from seat 18, so that the valve seal does not occlude ports 17*a* and hence fluid can flow from container 10 to discharge opening 16.

As the user forces the plunger inwardly towards the open position, the resilient element 25 is deformed. The closing or outward force applied by the resilient element 25 may rise as the plunger is displaced. However, the closing force does not increase linearly with inward displacement toward the open position. As schematically shown in graphical form in FIG. 8*a*, the closing force curve 46 for the valve as described above first rises with opening displacement from the closed position 40*a*, but then the increase in closing force per unit opening displacement declines until the plunger member and valve seal reaches a point of maximum closing force at an intermediate position 42*a*, at which point the outward or closing force begins to decline with increasing opening displacement. The valve preferably exhibits a maximum closing force of 2 to 2.5 pounds at intermediate position 42*a*. The outward or closing force exerted by the resilient section 25 then decreases further with further opening displacement. However, the plunger reaches the full open position 44*a*, where stop member 28 engages stop wall 29 (FIG. 5) and arrests opening displacement before the outward or closing force declines to zero. At such full open position 44*a*, the valve preferably requires a holding force of only 0.75 pounds. Stated another way, the dome-shaped or conical resilient section 25 provides a nonlinear spring characteristic with rising and falling force sections. The travel distance set by stop member 28 and stop wall 29 is selected so that the full open position lies on the falling force section of the characteristic curve, with an opening force less than the maximum achieved during travel. In the exemplary embodiment discussed above, the total travel from full closed position to full open position is from about 0.25 inches to 0.75 inches.

In a first alternate embodiment depicted by force curve 47*a*, resilient element 25 is provided with a greater average thickness of approximately 0.0155 inches, in turn requiring a larger closing force of approximately 3–3.5 pounds at intermediate position 42*a*', and thereafter exhibiting a declining closing force until reaching a minimum of approximately 0.75 pounds to hold the valve in an open position. Such an increased intermediate closing force has been shown to provide a greater snap-type closure effect upon releasing the valve from the full open position, thus reducing the risk of inadvertent operation of the valve.

Figure 8A:
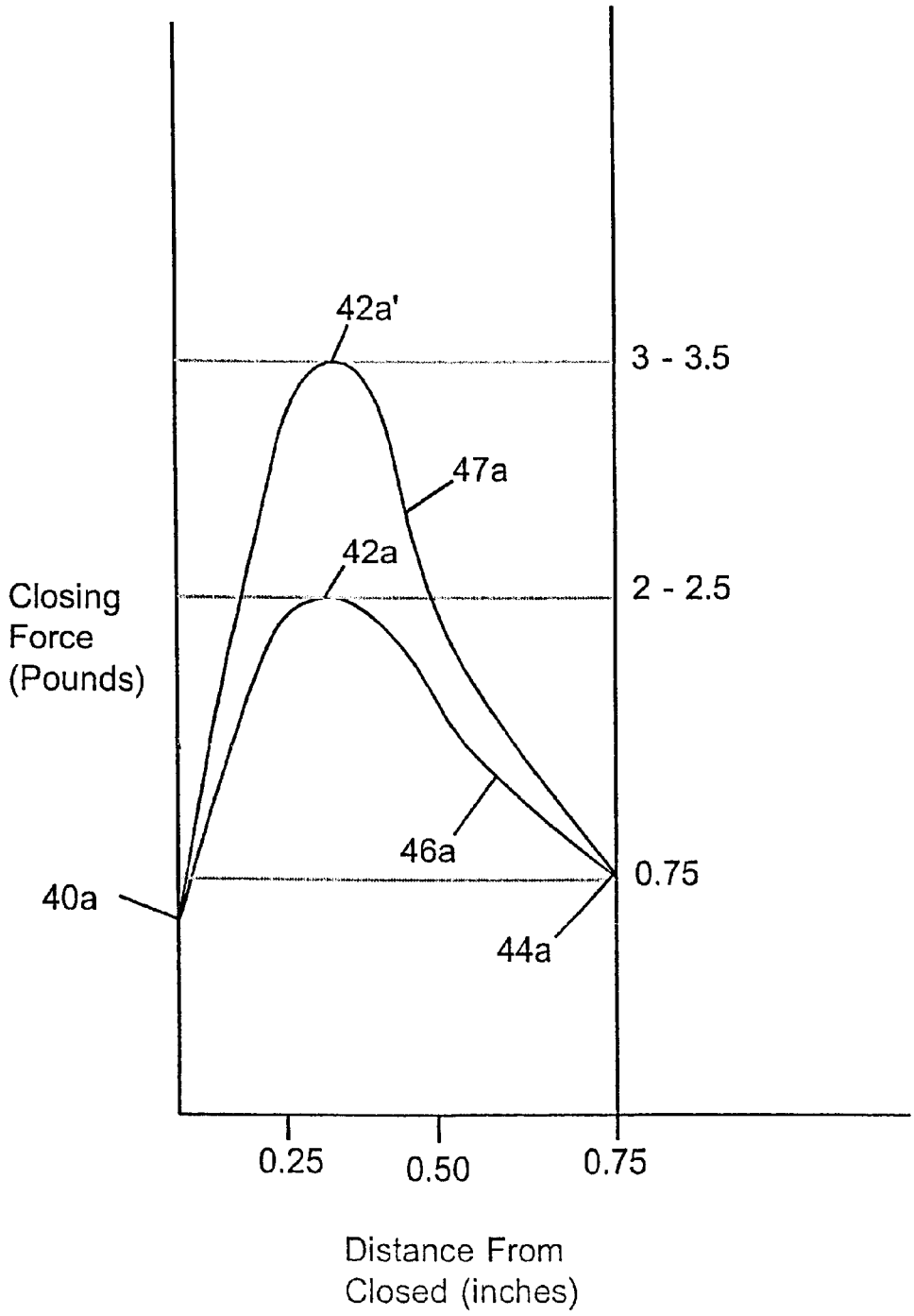
FIG. 8*a* is a graph illustrating certain forces acting during the operation of the valve of FIGS. 1–7 wherein the actuator is formed of a polypropylene copolymer.
Figure 8B:
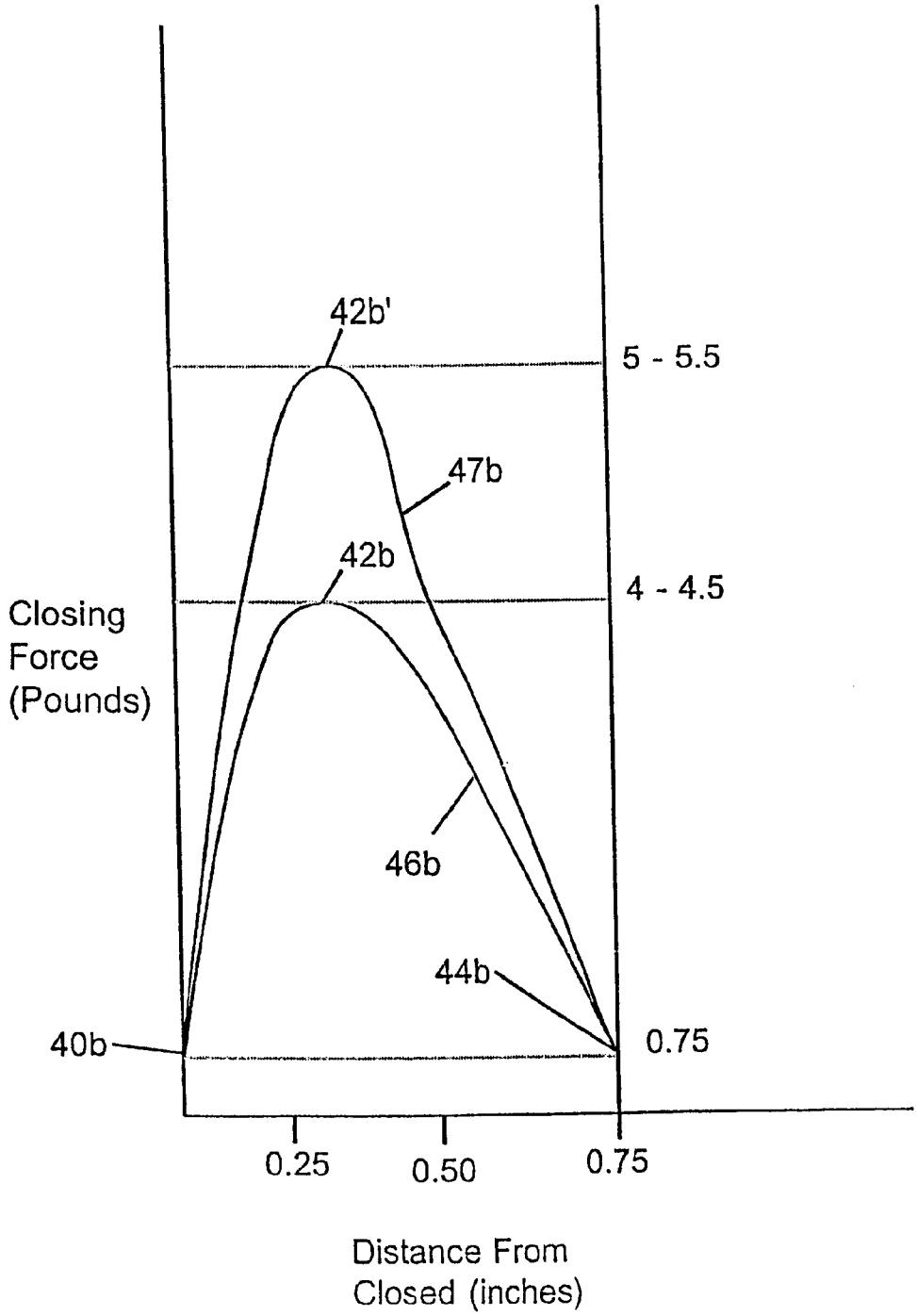
FIG. 8*b* is a graph illustrating certain forces acting during the operation of the valve of FIGS. 1–7 wherein the actuator is formed of polyethylene terephthalate.

In a second alternate embodiment depicted by force curve 46*b* of FIG. 8*b*, resilient element 25 is formed from polyethylene terephthalate (PET-C) and dimensioned as discussed above with an average thickness of 0.015 inches. Such a construction for resilient element 25 requires an even larger closing force of approximately 4–4.5 pounds at intermediate position 42*b*, and thereafter exhibiting a declining closing force until once again reaching a minimum of approximately 0.75 pounds to hold the valve in an open position.

Still further, in yet a third alternate embodiment depicted by force curve 47*b* of FIG. 8*b,* resilient element 25 is again formed from PET-C and dimensioned with an average thickness of 0.0155 inches, in turn requiring an even larger closing force of approximately 5–5.5 pounds at intermediate position 42*b*', and thereafter exhibiting a declining closing force until once again reaching a minimum of approximately 0.75 pounds to hold the valve in an open position.

Thus, by using alternate polymers and thicknesses of actuator 24, the force versus displacement curve may be modified as shown in the various force curves of FIGS. 8*a* and 8*b* so that during inward displacement from full closed position 40 to full open position 44, intermediate positions 42 exhibit greater closing forces, thus increasing the snap-type closure effect upon release of the valve actuator.

Furthermore, by constructing each of the valve elements as discussed above, namely, forming the valve body from a polypropylene copolymer having a minimum average wall thickness of 0.0625 inches, and forming the valve seal from a thermoplastic rubber having an average thickness of about 0.032 inches, the valve structure may be subjected to the vigorous sterilization processes necessary for using the valve in food applications, including irradiating the structure at up to 5.0 MRAD and subjecting the structure to high temperature chemical and steam sterilization processes, without causing the valve structure to become brittle or otherwise jeopardizing the integrity of the valve's structure or operation.

The non-linear spring characteristic provides several significant advantages. It can provide a substantial closing force at the full closed position, and hence an effective seal, with a low holding force at the full open position. The user can keep the valve open while the liquid is flowing with only moderate effort. The highest actuating forces are encountered only briefly, during travel from the closed position to the open position, and do not tend to cause fatigue. By contrast, in a valve with a conventional linear spring, the highest closing forces are encountered at the full open position, so that the user must continually resist such high forces while the liquid is flowing. Further, the nonlinear spring action provides a desirable "feel" or tactile feedback, which confirms to the user that the valve is open even if the user cannot see the flow or is not looking at the flow.

Because the finger gripping members 30 and 31 extend generally transverse to the discharge outlet 16, and extend generally horizontally during use of the valve, the user's fingers will be supported above the bottom end of the discharge opening, out of the stream of fluid discharged from the opening. Thus, if a hot fluid is being dispensed, it will not harm the user.

In the embodiment of the instant invention shown in FIG. 5, a separate push button element 60 is provided for manual engagement by a user to operate the dispensing valve. Push button 60 is preferably formed as a disk having a generally planar top surface 61 and a bottom surface 62 on the opposite side from the top surface 61. Extending downward from and centrally located on bottom surface 62 is an engagement pin 63. In the embodiment of the instant invention depicted in FIG. 5, the dome-shaped resilient section 25 of actuator 24 is provided with a central opening 64 sized to receive engagement pin 63 therein and to hold the same in place via a friction fit. Thus, depressing push button element 60 downward and into tubular volume body 13 likewise causes plunger member 21 and valve seal 19 to move in an opening direction aligned with the central axis of the valve body and transverse to valve port wall 17, precisely as described above. Preferably, engagement pin 63 is provided a circumferential ring 63*a* positioned around pin 63 adjacent to the point at which pin 63 attaches to bottom surface 62. Ring 63*a* defines a ledge 63*b* generally parallel to bottom surface 62. When inserted into actuator 24, pin 63 thus fits snugly within central opening 64 in actuator 24, while ledge 63*b* lies flush against the top face of actuator 24. Thus, when push button element 60 is pushed downward, only ledge 63*b* comes in contact with actuator 24, thus ensuring that the dome-shaped resilient section does not lose its shape or its nonlinear spring characteristic when the button is actuated.

In an alternate embodiment of the instant invention, push button element 60 further comprises a detachable tamper indicating ring 70 circumscribing push button element 60. Tamper indicating ring 70 is defined by an outer vertical wall 71, a top wall 72, and a short inner vertical wall 73 of smaller vertical dimension than outer wall 71. Outer vertical wall 71 has a thickness 71 a such that the bottom of outer vertical wall 71 defines a flat surface sized to seat against the actuation end 9 of tubular valve body 13 surrounding actuator 24. Inner vertical wall 73 is provided with a plurality of tabs 74 extending towards the interior of tamper indicating ring 7, each tab 74 having a narrow terminal section 75 at its bottom end, which terminal sections 75 are attached to the upper and outer edge of push button element 60. Tabs 74 are preferably configured so as to position push button element 60 substantially below the plane defined by the uppermost extent of top wall 72, such that when push button element 60 is assembled with actuator 24 within the dispensing valve 12, the outermost point of the actuation end 9 is top wall 72. Thus, by recessing push button 60 into the structure of dispensing valve 12 and below top wall 72, inadvertent or accidental actuation of the valve (through bumping against a surface, etc.) may be averted.

In use, a new dispensing valve 12 is provided on an unused container with push button element 60 installed in actuator 24 with tamper indicating ring 70 intact. Upon the first actuation of the valve through depression of push button 60, movement of tamper indicating ring 70 is blocked by the upper edge of tubular valve body 13, such that movement of push button element 60 into valve body 13 results in tamper indicating ring 70 separating from push button element 60 and falling away from dispensing valve 12. Thus, previous actuation of valve 12 may be readily apparent to a user based upon either the presence or absence of tamper indicating ring 70 from push button element 60.

Figure 9:
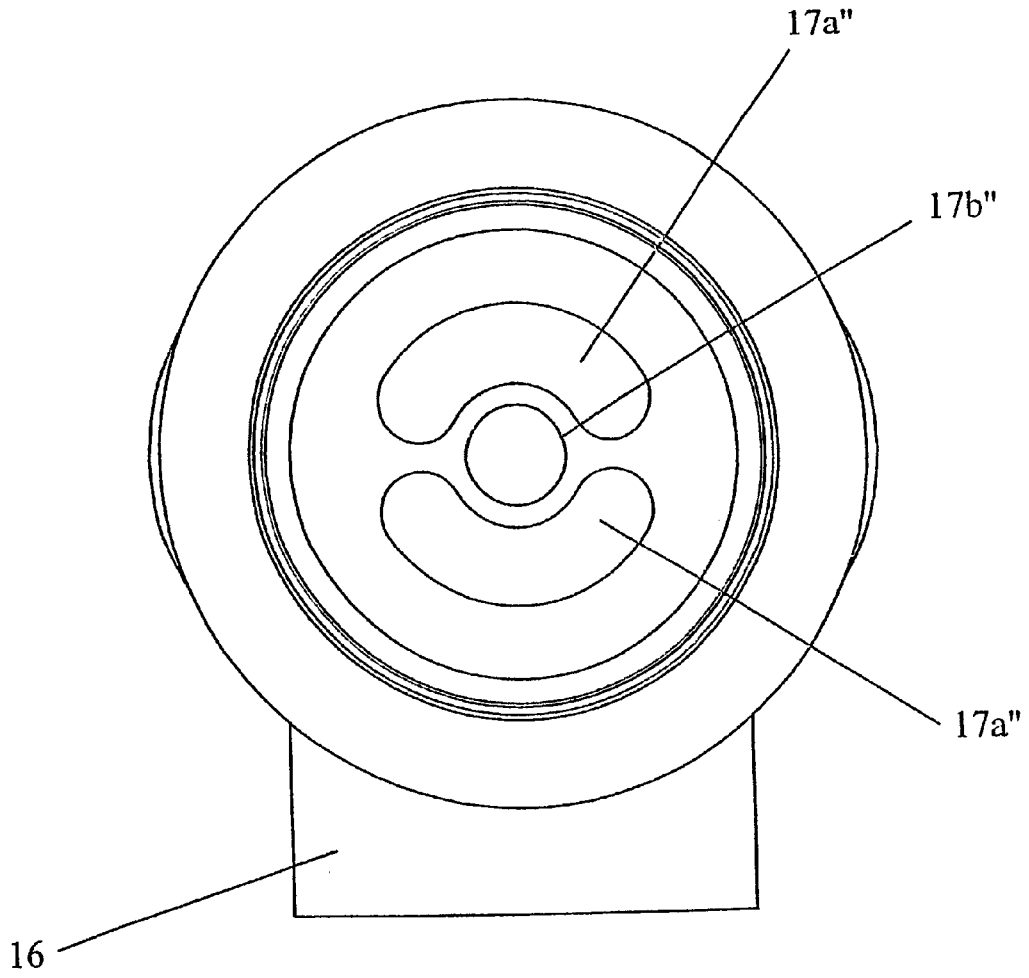
FIG. 9 is a view similar to FIG. 4 but depicting a valve body in accordance with a further embodiment of the invention.

The fluid flow resistance of the valve in the open position is controlled in large measure by the flow resistance of ports 17*a*. Thus, the fluid flow resistance of the valve can be selected to fit the application by selecting the number and size of the ports. The number and size of ports 17*a* can be varied through only slight modification of injection molding apparatus (such as by varying movable pin positions within such a mold structure). This allows the manufacturer to make valves for almost any application with only insignificant tooling costs. Ports 17*a* need not be round; other shapes, including arcuate ports 17*a*' (FIG. 9) extending partially around the center of the valve body and partially around plunger guide opening 17*b*', can be made with appropriate interchangeable injection molding components.

Since the dispensing valve 12 as above described is made with only a few parts formed by conventional, simple molding techniques, it is relatively simple in operation and cheap to manufacture. It is inherently reliable, and does not require extreme precision in manufacture.

Those skilled in the art of spring design will readily recognize that other shapes for the resilient element 25 of the actuator, such as rectangular, cruciform and octagonal can also be used without departing from the scope of the present invention. Also, as discussed above, the resilient element 25 may be disposed at the exposed or actuator end of the plunger, so that the resilient section acts as part of the push button and closes the actuator end of the housing. However, this is not essential, and the resilient element can be disposed within the valve body, at a location inaccessible to the user, as explained in detail above through use of push button element 60. Also, although it is highly advantageous to form the resilient element integrally with the plunger member, this is not essential. Conversely, the valve seal 19 can be formed integrally with the plunger member, rather than assembled to the plunger member as discussed above, with the resilient element attached afterwards. Furthermore, the resilient element may optionally be formed from plastic or metal.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A dispensing valve for fluids comprising:

a valve body having an inlet and a discharge outlet;

a valve port intermediate said inlet and said discharge outlet;

a resilient valve seal moveable from a closed position in which said valve seal occludes said valve port to an open position in which said valve seal does not occlude said valve port; and a resilient actuator comprising a conically disk-shaped resilient member, said resilient actuator operatively connected to said resilient valve seal and operatively engaging said valve body so that said resilient actuator exerts a closing force on said resilient valve seal biasing said resilient valve seal towards said closed position, said resilient actuator exhibiting a nonlinear relationship between said closing force and displacement of said resilient valve seal from said closed position.

2. The dispensing valve of claim 1 wherein said resilient actuator is configured such that said nonlinear relationship causes said closing force to decrease upon displacement of said resilient valve seal to said open position from an intermediate position between said open position and said closed position.

3. The dispensing valve of claim 2, wherein said resilient actuator is further configured such that a closing force is exerted on said resilient valve seal when said resilient valve seal is in said open position, said closed position, and any position therebetween.

4. The dispensing valve of claim 2, wherein said resilient actuator is further configured such that said closing force increases upon displacement of said resilient valve seal from said closed position to said intermediate position.

5. The dispensing valve of claim 1, further comprising:

a plunger member reciprocally mounted within said valve body and having an outer end and an inner end, said outer end being attached to said resilient actuator, and said inner end being attached to said resilient valve seal.

6. The dispensing valve of claim 5, further comprising:

means for arresting opening movement of said plunger member and said resilient valve seal when said plunger member and said resilient valve seal reach said open position.

7. The dispensing valve of claim 5, further comprising:

a stop element on said plunger member and a stop element on said valve body, said stop elements engaging one another so as to arrest opening movement of said plunger member and said resilient valve seal when said plunger member and said resilient valve seal reach said open position.

8. The dispensing valve of claim 5, wherein said resilient actuator is formed integrally with said plunger member.

9. The dispensing valve of claim 5, wherein said outer end of said plunger member is exposed for manual engagement by a user to open said dispensing valve, and said resilient actuator forms at least part of a push button for manual engagement by the user.

10. The dispensing valve of claim 9, wherein said valve body has an actuation end remote from said inlet and an actuator opening at said actuation end, said push button substantially occluding said actuator opening.

11. The dispensing valve of claim 5, said conically disk-shaped resilient member having a central portion connected to said plunger member and a peripheral portion engaged with said valve body.

12. The dispensing valve of claim 5, further comprising:

a push button element exposed for manual engagement by a user to open said dispensing valve, said push button element being frictionally held by said resilient actuator.

13. The dispensing valve of claim 12, said push button element further comprising a generally planar disc having a top surface and a bottom surface, an engagement pin extending outward from said bottom surface, and a ring surrounding a portion of said engagement pin adjacent said bottom surface and defining a ledge generally parallel to said bottom surface.

14. The dispensing valve of claim 13, said pin being frictionally held within an opening in a top surface of said resilient actuator, and said ledge abutting said top surface of said resilient actuator adjacent said opening.

15. The dispensing valve of claim 12, said push button element further comprising a tamper indicating ring circumscribing said push button element and detachably affixed thereto.

16. The dispensing valve of claim 15, said tamper indicating ring comprising an outer vertical wall, a top wall, a bottom wall, and an inner vertical wall, and a plurality of tabs on said inner vertical wall having a weakened portion detachably holding said push button element.

17. The dispensing valve of claim 16, said plurality of tabs detachably holding a top surface of said push button in a vertical position below said top wall of said tamper indicating ring.

18. A dispensing valve for fluids comprising:

a valve body having an inlet and a discharge outlet;

a valve port wall intermediate said inlet and said discharge outlet, said valve port wall having a plurality of valve ports extending therethrough and defining a valve seal seat surrounding said valve ports;

a resilient valve seal operatively engaged with said valve body and moveable from a closed position in which said valve seal occludes said valve ports to an open position in which said valve seal does not occlude said valve ports, said valve seal scat supporting said valve seal against buckling under the influence or fluid pressure applied at said inlet when said valve seat is in said closed position; and a resilient actuator exhibiting a nonlinear relationship between a closing force exerted by said resilient actuator on said resilient valve seal and displacement of said resilient valve seal from said closed position.

19. The dispensing valve of claim 18, said resilient actuator being operatively connected to said resilient valve seal and operatively engaging said valve body so that said resilient actuator exerts said closing force on said resilient valve seal biasing said resilient valve seal towards said closed position.

20. The dispensing valve of claim 19 wherein said resilient actuator is configured such that said nonlinear relationship causes said closing force to decrease upon displacement of said resilient valve seal to said open position from an intermediate position between said open position and said closed position.

21. The dispensing valve of claim 20, wherein said resilient actuator is further configured such that at least some closing force is exerted on said resilient valve seal when said resilient valve seal is in said open position, said closed position, and any position therebetween.

22. The dispensing valve of claim 20, wherein said resilient actuator is further configured such that said closing force increases upon displacement of said resilient valve seal from said closed position to said intermediate position.

23. The dispensing valve of claim 19, further comprising:

a plunger member reciprocally mounted within said valve body and having an outer end and an inner end, said outer end being attached to said resilient actuator, and said inner end being attached to said resilient valve seal.

24. The dispensing valve of claim 23, further comprising:

means for arresting opening movement of said plunger member and said resilient valve seal when said plunger member and said resilient valve seal reach said open position.

25. The dispensing valve of claim 23, further comprising:

a stop element on said plunger member and a stop element on said valve body, said stop elements engaging one another so as to arrest opening movement of said plunger member and said resilient valve seal when said plunger member and said resilient valve seal reach said open position.

26. The dispensing valve of claim 23, wherein said resilient actuator is formed integrally with said plunger member.

27. The dispensing valve of claim 23, wherein said outer end of said plunger member is exposed for manual engagement by a user to open said dispensing valve, and said resilient actuator forms at least part of a push button for manual engagement by the user.

28. The dispensing valve of claim 27, wherein said valve body has an actuation end remote from said inlet and an actuator opening at said actuation end, said push button substantially occluding said actuator opening.

29. The dispensing valve of claim 23, said resilient actuator further comprising a generally conical form having a central portion connected to said plunger member and a peripheral portion engaged with said valve body.

30. The dispensing valve of claim 23, further comprising:

a push button element exposed for manual engagement by a user to open said dispensing valve, said push button element being frictionally held by said resilient actuator.

31. The dispensing valve of claim 30, said push button element further comprising a generally planar disc having a top surface and a bottom surface, an engagement pin extending outward from said bottom surface, and a ring surrounding a portion of said engagement pin adjacent said bottom surface and defining a ledge generally parallel to said bottom surface.

32. The dispensing valve of claim 31, said pin being frictionally held within an opening in a top surface of said resilient actuator, and said ledge abutting said top surface of said resilient actuator adjacent said opening.

33. The dispensing valve of claim 30, said push button element further comprising a tamper indicating ring circumscribing said push button element and detachably affixed thereto.

34. The dispensing valve of claim 33, said tamper indicating ring comprising an outer vertical wall, a top wall, a bottom wall, and an inner vertical wall, and a plurality of tabs on said inner vertical wall having a weakened portion detachably holding said push button element.

35. The dispensing valve of claim 34, said plurality of tabs detachably holding a top surface of said push button in a vertical position below said top wall of said tamper indicating ring.

36. A dispensing valve for fluids comprising:

a valve body having an inlet and a discharge outlet;

a valve port intermediate said inlet and said discharge outlet;

a resilient valve seal moveable from a closed position in which said valve seal occludes said valve port to an open position in which said valve seal does not occlude said valve port; and a resilient actuator operatively connected to said resilient valve seal and operatively engaging said valve body so that said resilient actuator exerts a closing force on said resilient valve seal biasing said resilient valve seal towards said closed position, said resilient actuator exhibiting a nonlinear relationship between said closing force and displacement of said resilient valve seal from said closed position;

said valve body, said valve port, said resilient valve seal, and said resilient actuator being formed from materials selected for their ability to withstand gamma and cobalt irradiation exposure of at least 5.0 MRAD.

37. A dispensing valve for fluids comprising:

a valve body having an inlet and a discharge outlet;

a valve port intermediate said inlet and said discharge outlet;

a valve seal moveable from a closed position in which said valve seal occludes said valve port to an open position in which said valve seal does not occlude said valve port;

a resilient actuator comprising a conically disk-shaped resilient member, said resilient actuator operatively connected to said valve seal and operatively engaging said valve body so that said resilient actuator exerts a closing force on said valve seal biasing said valve seal towards said closed position, said resilient actuator exhibiting a nonlinear relationship between said closing force and displacement of said valve seal from said closed position; and a push button engaging said resilient actuator such that displacing said push button towards said valve body causes said resilient actuator to move said valve seal from said closed position to said open position, and releasing said push button causes said resilient actuator to move said valve seal from said open position to said closed position.

38. The dispensing valve of claim 37, said resilient actuator having a first stop member attached thereto configured to terminate movement of said actuator into said valve body.

39. The dispensing valve of claim 38, said valve body further comprising a second stop member configured to engage said first stop member so as to arrest opening movement of said plunger member and said valve seal when said plunger member and said valve seal reach said open position.

40. The dispensing valve of claim 37 wherein said resilient actuator is configured such that said nonlinear relationship causes said closing force to decrease upon displacement of said valve seal to said open position from an intermediate position between said open position and said closed position.

41. The dispensing valve of claim 40, wherein said resilient actuator is further configured such that at least some closing force is exerted on said valve seal when said valve seal is in said open position, said closed position, and any position therebetween.

42. The dispensing valve of claim 40, wherein said resilient actuator is further configured such that said closing force increases upon displacement of said valve seal from said closed position to said intermediate position.

43. The dispensing valve of claim 37, further comprising:

a plunger member reciprocally mounted within said valve body and having an outer end and an inner end, said outer end being attached to said resilient actuator, and said inner end being attached to said valve seal.

44. The dispensing valve of claim 43, wherein said resilient actuator is formed integrally with said plunger member.

45. The dispensing valve of claim 37, said push button further comprising a generally planar disc having a top surface and a bottom surface, an engagement pin extending outward from said bottom surface, and a ring surrounding a portion of said engagement pin adjacent said bottom surface and defining a ledge generally parallel to said bottom surface.

46. The dispensing valve of claim 45, said pin being frictionally held within an opening in a top surface of said resilient actuator, and said ledge abutting said top surface of said resilient actuator adjacent said opening.

47. The dispensing valve of claim 37, said push button further comprising a tamper indicating ring circumscribing said push button and detachably affixed thereto.

48. The dispensing valve of claim 47, said tamper indicating ring comprising an outer vertical wall, a top wall, a bottom wall, and an inner vertical wall, and a plurality of tabs on said inner vertical wall having a weakened portion detachably holding said push button element.

49. The dispensing valve of claim 48, said plurality of tabs detachably holding a top surface of said push button in a vertical position below said top wall of said tamper indicating ring.

* * * * *